US009039673B2

(12) United States Patent
Weitzel et al.

(10) Patent No.: US 9,039,673 B2
(45) Date of Patent: May 26, 2015

(54) UNITARY WITHDRAWAL SPIKE UNIT SUITABLE FOR FACTORY FITTING

(75) Inventors: Dietmar Weitzel, Marburg (DE); Astrid Hoffmann, Marburg (DE)

(73) Assignee: Novartis AG, Basel (CH)

( * ) Notice: Subject to any disclaimer, the term of this patent is extended or adjusted under 35 U.S.C. 154(b) by 465 days.

(21) Appl. No.: 12/812,015

(22) PCT Filed: Jan. 9, 2009

(86) PCT No.: PCT/IB2009/000139

§ 371 (c)(1),
(2), (4) Date: Sep. 24, 2010

(87) PCT Pub. No.: WO2009/087572

PCT Pub. Date: Jul. 16, 2009

(65) Prior Publication Data

US 2011/0022023 A1 Jan. 27, 2011

Related U.S. Application Data

(60) Provisional application No. 61/010,587, filed on Jan. 9, 2008.

(51) Int. Cl.
*A61J 1/20* (2006.01)
*B65B 3/04* (2006.01)
(Continued)

(52) U.S. Cl.
CPC ..... *A61J 1/2096* (2013.01); *A61J 1/1412* (2013.01); *A61J 2001/2068* (2013.01);
(Continued)

(58) Field of Classification Search
CPC ..... A61J 1/00; A61J 1/1406; A61J 1/1412; A61J 1/18; A61J 1/2089; A61J 1/2096; A61J 2001/20; A61J 2001/2006; A61J 2001/201; A61J 2001/2065; A61J 2001/145; A61J 2001/1456; A61J 2001/2082; A61J 2001/2086; A61J 1/1443; A61J 11/0025; A61J 2001/1443; A61J 2001/2003; A61J 2001/2079
USPC ..... 604/403, 405, 406, 411, 412, 414, 415, 604/416
See application file for complete search history.

(56) References Cited

U.S. PATENT DOCUMENTS 3,592,245 A * 7/1971 Schneller et al. ..... 141/25
3,734,098 A * 5/1973 Schneller et al. ..... 604/405
(Continued)

FOREIGN PATENT DOCUMENTS

EP 0692235 A 1/1996
EP 0856331 A 8/1998
(Continued)

OTHER PUBLICATIONS

Guidance for Industry Sterile Drug Products Produced by Aseptic Processing—Current Good Manufacturing Practice. U.S. Department of Health and Human Services, Food and Drug Administration. Sep. 2004. pp. 4-9, 27, 28, 56-58. http://www.fda.gov/downloads/Drugs/.../Guidances/ucm070342.pdf. Accessed Nov. 19, 2013.*
(Continued)

*Primary Examiner* — Adam Marcetich
(74) *Attorney, Agent, or Firm* — Morrison & Foerster LLP

(57) ABSTRACT

A withdrawal spike unit (200) comprises a withdrawal spike component (30') and an integrally formed adapter component (60') that is adapted to couple with a vial (10) in a safe and secure manner. The integral formation of the component parts (30', 60') makes fully automated manufacture and assembly of assemblies comprising such a withdrawal spike unit (200) coupled to a vial (10) possible. As such, human errors associated with the assembly at the point of use are mitigated.

43 Claims, 8 Drawing Sheets

(51) Int. Cl.
*A61J 1/14* (2006.01)
*A61J 1/18* (2006.01)

(52) U.S. Cl.
CPC ..... *A61J 1/18* (2013.01); *A61J 2001/2086* (2013.01); *A61J 1/1443* (2013.01); *A61J 2001/2079* (2013.01); *A61J 2001/2072* (2013.01); *A61J 1/1406* (2013.01); *A61J 2001/201* (2013.01); *A61J 2001/2037* (2013.01); *A61J 2001/2055* (2013.01); *A61J 2001/2065* (2013.01); *A61J 2001/2075* (2013.01); *A61J 2001/2082* (2013.01); *A61J 2001/1425* (2013.01)

(56) References Cited

U.S. PATENT DOCUMENTS

| | | | | | |
|---|---|---|---|---|---|
| 4,261,462 | A * | 4/1981 | Wysocki | 206/463 |
| 4,576,211 | A * | 3/1986 | Valentini et al. | 141/329 |
| 4,759,756 | A * | 7/1988 | Forman et al. | 604/413 |
| 4,872,494 | A * | 10/1989 | Coccia | 141/383 |
| 5,279,576 | A * | 1/1994 | Loo et al. | 604/187 |
| 5,304,163 | A | 4/1994 | Bonnici et al. | |
| 5,526,853 | A * | 6/1996 | McPhee et al. | 141/329 |
| 6,036,171 | A | 3/2000 | Weinheimer et al. | |
| 6,050,415 | A * | 4/2000 | Lind et al. | 206/462 |
| 6,079,561 | A * | 6/2000 | Burkard | 206/461 |
| 6,656,433 | B2 * | 12/2003 | Sasso | 422/569 |
| 2002/0040206 | A1 * | 4/2002 | Heil et al. | 604/202 |
| 2002/0107500 | A1 * | 8/2002 | Takagi | 604/406 |
| 2003/0070726 | A1 * | 4/2003 | Andreasson et al. | 141/329 |
| 2003/0153895 | A1 * | 8/2003 | Leinsing | 604/403 |
| 2003/0199847 | A1 * | 10/2003 | Akerlund et al. | 604/411 |
| 2004/0158204 | A1 * | 8/2004 | Reboul | 604/126 |
| 2004/0243065 | A1 * | 12/2004 | McConnell et al. | 604/183 |
| 2004/0260266 | A1 * | 12/2004 | Cuschieri et al. | 604/411 |
| 2005/0055008 | A1 * | 3/2005 | Paradis et al. | 604/403 |
| 2005/0137566 | A1 * | 6/2005 | Fowles et al. | 604/412 |
| 2006/0079834 | A1 | 4/2006 | Tennican et al. | |
| 2006/0108319 | A1 | 5/2006 | Meittunen | |
| 2006/0138009 | A1 * | 6/2006 | Bozkurt | 206/467 |
| 2007/0060904 | A1 * | 3/2007 | Vedrine et al. | 604/411 |
| 2007/0078428 | A1 | 4/2007 | Reynolds et al. | |
| 2007/0079894 | A1 * | 4/2007 | Kraus et al. | 141/319 |
| 2007/0156112 | A1 * | 7/2007 | Walsh | 604/415 |
| 2007/0208296 | A1 * | 9/2007 | Paproski et al. | 604/82 |
| 2008/0172024 | A1 * | 7/2008 | Yow | 604/411 |
| 2009/0159486 | A1 * | 6/2009 | Senter | 206/576 |
| 2009/0304739 | A1 * | 12/2009 | Rappuoli et al. | 424/206.1 |

FOREIGN PATENT DOCUMENTS

| | | | |
|---|---|---|---|
| FR | 2894463 | A | 6/2007 |
| WO | WO-8504801 | A1 | 11/1985 |
| WO | WO-9702853 | A1 | 1/1997 |
| WO | WO-9832411 | A1 | 7/1998 |
| WO | WO-103641 | A1 | 1/2001 |
| WO | WO 0103641 | A1 * | 1/2001 |
| WO | WO-03066152 | A2 | 8/2003 |
| WO | WO-2005/115504 | A2 | 12/2005 |
| WO | WO-2006/099441 | A | 9/2006 |
| WO | WO-2007079048 | A2 | 7/2007 |
| WO | WO-2007140238 | A2 | 12/2007 |
| WO | WO-2008/117178 | A2 | 10/2008 |

OTHER PUBLICATIONS

Gosbell et al. (Sep. 14, 2010). "Immunisation and multi-dose vials," Vaccine 28(40):6556-61.

International Search Report mailed May 27, 2009, for PCT Application No. PCT/IB09/000139 filed Jan. 9, 2008, 4 pages.

* cited by examiner

UNITARY WITHDRAWAL SPIKE UNIT SUITABLE FOR FACTORY FITTING

CROSS REFERENCE TO RELATED APPLICATIONS

This is a U.S. National Phase patent application of PCT/IB2009/000139, filed Jan. 9, 2009, which claims priority to U.S. Provisional patent application Ser. No. 61/010,587 filed Jan. 9, 2008, all of which are hereby incorporated by reference in the present disclosure in their entirety.

TECHNICAL FIELD

This invention relates to withdrawal spike units. In particular, the invention concerns withdrawal spike units comprising a withdrawal spike and an integrally formed adapter for coupling to a vial in a safe and secure manner.

BACKGROUND ART

In a standard vaccination programme, single dose vials containing substantially a single dose (e.g. 0.5 ml volume) of a given vaccine are used. Each vial is hermetically sealed on production, for example by a rubber stopper or septum which is inserted into an opening in the vial. The contents of the vial are accessed when required by puncturing the seal with a sterile injection device, such as a syringe, and withdrawing the contents into the injection device. The vial contents may alternatively be withdrawn into a sterile intermediary device for subsequent withdrawal into a sterile injection device. In this manner, the contents remain sterile up to the point of injection into a subject.

Vials containing more than a single dose of a medicament are known as multidose vials. Various such multidose vials are well known in the art. A typical example is illustrated in FIG. 1 and described in greater detail below under the section entitled "Vials".

As set out in greater detail below under the section entitled "ISO Standards for Vials", vials are subject to ISO standards including ISO 8362-1, ISO 8632-2, ISO 8632-3 and ISO 8632-4.

A problem associated with multidose vials is that once the seal has been penetrated in order to withdraw a first dose from the vial, the chamber may no longer be sterile. For example, penetrating a seal with an injection device could leave a puncture hole in the seal. Alternatively, where a self-sealing type of seal, such as a septum, is used, fragmentation problems might occur. An example of such fragmentation problems includes the dislodgement of a fragment of the septum into the chamber on insertion of the injection device. After removal of the first dose, therefore, the contents may lose sterility.

Sterility may be maintained by the use of a component within the vial contents which may include preservatives such as thiomersal or 2-phenoxyethanol. It is preferred, however, that the components should be substantially free from preservatives, and an objective of the invention is to maintain sterility in a multidose vial during and after the withdrawal of a first dose therefrom, without the use of preservatives within the vial contents.

As disclosed in WO2008/117178, entitled "Multidose Vial Adapter", sterility may also be maintained by the use of a sterile withdrawal spike. Such sterile withdrawal spikes are known in the art. One example is the Mini Spike™ produced by B. Braun™. A typical example of a sterile spike 30 is illustrated in FIG. 2 and disclosed in US2002/0040206. Interior details are illustrated in FIG. 10. Further details are set out below in the section entitled "Sterile Spike".

The various problems identified under "Sterile Spike" are addressed in WO2008/117178, by the provision of an adapter 60 to interconnect a multidose vial 10 with a withdrawal spike 30. The adapter is described in detail below under the section entitled "The adapter of 'Multidose Vial Adapter'".

A potential problem with the solution proposed in WO 2008/117178 has been envisaged, however. Automated interconnection of the three component parts might be difficult to achieve in some circumstances. Whereas automated coupling of the withdrawal spike 30 to the adapter 60 might be achievable, the subsequent step of coupling the assembled adapter 60 with withdrawal spike 30 coupled thereto to the vial 10 is likely to be practically unachievable in an automated manner. This has the consequence that at least the vial 10 will be supplied without having been assembled together with the other component parts of the assembly. Assembly will therefore take place at the point of use, e.g. at a clinic.

Point of use assembly can be unsatisfactory; firstly because there remains scope for incorrect assembly of the component parts by underskilled personnel, for example; and secondly because the component parts must be supplied separately. Hence, there is a risk that the parts could become separated (even if supplied together) which may result in preservative-free vials intended for use only with a sterile withdrawal spike and adapter being confused with vials containing preservative. This could then result in contaminated doses being inadvertently administered.

To that end, it is an objective of the invention to simplify the interconnection required between the component parts so that they can be supplied pre-assembled.

DISCLOSURE OF THE INVENTION

The invention facilitates the pre-assembly, prior to shipping, of a withdrawal spike with a multidose vial in a safe and secure manner.

According to a first aspect, the invention provides a withdrawal spike unit comprising a withdrawal spike and an integral adapter configured to couple with a vial, the adapter comprising:

- a hollow body defined by an outer wall having a first end and a second end formed integrally with the withdrawal spike; and
- a retaining member at the first end adapted to retain at least a portion of the vial;
- such that the withdrawal spike is locatable in a predetermined position with respect to the vial.

According to a second aspect, the invention provides an assembly comprising:

- a vial; and
- a withdrawal spike unit as defined in the first aspect.

According to a third aspect, the invention provides a method of assembling an assembly for administering multiple doses of a component, comprising the steps of:

- providing a vial containing the component;
- providing a withdrawal spike unit as defined in the first aspect; and
- fitting the withdrawal spike unit onto the vial.

According to a fourth aspect, the invention provides a method of preparing multiple doses of a component comprising the steps of:

- assembling the assembly in accordance with the third aspect of the invention;
- inserting an injection device into the withdrawal spike;

withdrawing substantially a dose of component from the vial into the injection device through the spike; and repeating the inserting and withdrawal steps using further injection devices.

According to a fifth aspect, the invention provides a withdrawal spike comprising:

a housing; and a piercing thorn, the thorn protruding (e.g. centrally and perpendicularly) from the housing, wherein a fluid flowpath is defined though the housing and the thorn, and wherein the withdrawal spike further comprises a swabbable valve in the flowpath within the housing.

According to a sixth aspect, the invention provides an adapter for attaching to a vial for withdrawal of the vial's contents, comprising (i) a hollow body for receiving and retaining a vial, and (ii) a withdrawal spike for penetrating the vial and permitting liquid to be withdrawn therefrom. The body and the spike should form a single unit, or else they should be joined to each other such that they cannot be separated from each other (e.g. under normal operating conditions) after the spike has penetrated the vial. Similarly, the adapter includes a retaining member such that it cannot be separated from the vial (again, under normal operating conditions) once the spike has penetrated the vial. These features mean that, once a spike is introduced into a vial, it stays in place, thereby providing a closed system and facilitating the maintenance of sterility. Moreover, after an adapter has been fitted to a vial then a retaining member should also ensure that it cannot be separated from the vial (again, under normal operating conditions), even before spike penetration. If the adapter can be removed from the vial then there is a risk that a preservative-free vaccine will escape into circulation and may be used as if it included a preservative.

According to a seventh aspect, the invention provides an assembly comprising a vial and an adapter of the sixth aspect.

According to an eighth aspect, the invention provides an assembly comprising: a vial having an aperture that is closed by a penetrable seal to retain liquid within the vial; an adapter inseparably attached to the vial and positioning a withdrawal spike outside the penetrable seal; an actuator for moving the spike from its position outside the seal to a position in which it irreversibly penetrates the seal and provides an exit path for liquid from the vial via the aperture. Thus the spike is held outside the vial by the adapter, and the adapter cannot accidentally be removed from the vial. Moreover, once the spike has been inserted into the vial through the seal then it cannot be withdrawn.

Assemblies of adapters and vials may additionally include a seal to prevent the spike and other parts of the assembly from becoming contaminated during storage. If the assembly is sterilised during manufacture and an outer hermetic seal is added then sterility therewithin can be maintained until the time of use. Once opened, and after a spike has been inserted into a vial, the external interface of the adapter may be protected e.g. by a swabbable valve, as described in more detail below.

As described above, the vial will generally be a multidose vial. Although the invention can be used with preservative-containing contents, they are preferably preservative-free.

The Integral Adapter

The retaining member may comprise at least one inwardly extending projection. The or each projection may be disposed at a free end of an associated resiliently deflectable tab that is defined by a pair of slots in the outer wall, the slots extending at least partially from the first end towards the second end of the outer wall. The or each projection may include a camming surface for engagement by at least a portion of the vial. The outer wall may include a thinned portion between the ends of the pair of slots at the fixed end of the or each tab to aid tab deflection.

The withdrawal spike may comprise a housing and a piercing thorn protruding centrally and perpendicularly from the housing, wherein a fluid flowpath is defined through the housing and the thorn. The withdrawal spike may include a swabbable valve. The withdrawal spike may further comprise a flange extending from the second end of the adapter body, the flange being formed integrally with the housing of the withdrawal spike. Where the adapter includes a flange extending from the second end, the flange may comprise an annular disc that includes a rim extending about at least a portion of the flange periphery, the flange and rim being contiguous with the housing of the withdrawal spike.

The withdrawal spike unit may further comprise a skirt projecting from the first end of the adapter body. The skirt may be configured to enshroud at least a portion of the vial, with an inner surface of the skirt having a shape that is adapted to match the contours of the relevant portion of the vial.

The withdrawal spike unit may further comprise at least one gripping surface. This may comprise a pair of opposed gripping surfaces, each disposed on an outer surface of a boss projecting outwardly from the outer wall of the adapter body.

The withdrawal spike unit may comprise a thermoplastic moulding.

In accordance with the second aspect of the invention, the vial may comprise a shell defining an interior chamber having an opening and a cap hermetically sealing the opening. The cap may comprise a plug portion. The chamber may contain multiple doses of a vaccine, such as an influenza vaccine. The component may be preservative free. The retaining member at the first end of the adapter body may retain at least a portion of the vial such that the withdrawal spike is located in a predetermined position with respect to the vial. The vial cap may be received in the hollow body of the adapter and may be engaged by the retaining member.

When the withdrawal spike comprises a housing and a piercing thorn, the thorn protruding centrally and perpendicularly from the housing, the predetermined position may comprise the thorn being inserted through the vial cap by a predetermined distance. The assembly may further comprise packaging encapsulating the assembled vial and withdrawal spike unit. The packaging may comprise a base and a cover secured to the base, the base and cover together defining a compartment within which are housed the withdrawal spike unit and the vial. The base may comprise a board. The cover may be a moulded plastics component. Optionally, the cover is transparent.

In accordance with the third aspect of the invention, the step of providing the vial may comprise the sub-steps of: providing a shell defining an interior chamber having an opening; filling the chamber with contents; and hermetically sealing the opening with a cap. Hermetically sealing the opening with a cap may comprise pushing a plug portion into the opening; and adding a skirt enshrouding the plug portion and at least a portion of the vial. Preferably the cap is in a state such that the withdrawal spike unit can be fitted without having to first remove any components from the outside of the vial.

Where the or each projection includes a camming surface for engagement by at least a portion of the vial, the fitting step may comprise: engaging the camming surface of the or each projection with the vial cap; resiliently deflecting outwardly the associated deflectable tab to a deflected position via a relative axial force between the vial and the adapter; and passing the cap beyond the or each projection, the or each projection hence returning from the deflected position to retain the cap within the hollow adapter body.

The method may further include the step of removing a flip-off disk from the vial prior to the fitting step.

The method may further comprise a step of encapsulating the vial and withdrawal spike unit in packaging.

The encapsulating step may take place prior to the fitting step, in which case the fitting step occurs after the subsequent removal of the withdrawal spike unit and the vial from the packaging. The steps of removing the packaging and fitting the withdrawal spike unit onto the vial may take place at the point of use.

Alternatively, each step may be carried out at the place of manufacture. The fitting step may be carried out in an automated manner.

In accordance with either the third aspect of the invention, the component may comprise a vaccine, such as an influenza vaccine. The component may be preservative free.

A vial will typically be made of a glass or plastic material, according to the ISO standards detailed above. Where a glass is used, then it is preferred to use a borosilicate glass rather than a soda lime glass.

A vial is preferably sterilized before a component is added to it.

To avoid problems with latex-sensitive patients, the devices preferably do not include latex components.

An assembly according to the second aspect of the invention may be packaged together with a delivery device, such as a syringe, or may be packaged together with a set of such delivery devices corresponding to the number of doses contained in the vial. Where a composition/component is packaged with a syringe, the syringe will not normally have a needle attached to it, although a separate needle may be supplied with the syringe for assembly and use. Thus, delivery devices do not necessarily come packaged with an associated needle unit, but are suitable to have a needle unit attached to them.

Methods of Treatment, and Administration of the Vaccine

Devices of the invention are suitable for administration of vaccines to human or animal patients, and the invention provides a method of raising an immune response in a patient, comprising the step of administering a composition from a vial to the patient.

Vials

With reference to FIG. 1, a multidose vial 10 comprises an outer shell 12 defining a main body portion 14 and a narrower neck portion 16. A tapering shoulder portion 18 connects the body and neck portions. The body, neck and shoulder portions together define an interior chamber 20 for containing multiple doses of a medicament. The chamber 20 might have a volume of about 5.5 ml, hence being sufficient to contain ten standard 0.5 ml doses of a vaccine (allowing for a standard 10% overfill allowance).

The neck portion 16 includes a lip 22 and defines an opening into the chamber 20. A cap 24 includes a plug portion 26, typically of rubber, that fills at least a portion of the interior space defined by the neck portion 16. The cap further includes a skirt 28, typically of aluminium, that enshrouds the lip 22. The cap 24 hence hermetically seals the opening. A flip-off disc (not shown), typically of a plastic material, overlies the upper surface of the cap 24, hence preventing contamination of the plug portion 26 prior to use.

ISO Standards for Vials

ISO 8362-1 specifies the form, dimensions and capacities of glass vials for injectable preparations. It also specifies the material from which such containers shall be made and the performance requirements of those containers. It applies to colourless or amber glass containers made from borosilicate or soda-lime glass, in the form of glass tubing, whether internally surface-treated or not, and intended for use in the packaging, storage or transportation of products intended for injection.

ISO 8362-4 specifies the shape, dimensions and capacities of glass vials for injectable preparations. It also specifies the material from which such containers shall be made and the performance requirements for the containers. It applies to colourless or amber glass containers moulded from borosilicate or soda-lime glass, with or without an internal surface treatment, and intended to be used in the packaging, storage or transportation of products intended for injection.

ISO 8632-2 specifies the design, dimensions, material, performance, requirements and tests for single-use closures for injection vials covered by ISO 8362-1 and ISO 8362-4.

ISO 8632-3, ISO 8632-6 and ISO 8632-7 respectively specify details for aluminium caps for injection vials, caps made of aluminium-plastics combinations for injection vials, and injection caps made of aluminium-plastics combinations without overlapping plastics part.

It will be appreciated, however, that the multidose vial may take any suitable shape, and that the opening may be sealed in any suitable manner.

Sterile Spike

The sterile spike 30 comprises a housing 32 and a piercing thorn 34 protruding centrally and perpendicularly from the housing. The housing 32 is plate-shaped and comprises a first filter chamber 3 containing a fluid filter 5 and a second filter chamber 7 containing an air filter 9. The thorn 34 has a piercing tip 36. A fluid duct 11 and an air duct 13 extend in longitudinal direction through the piercing thorn 34. Said two ducts end in the conical area of the tip 36 of the piercing thorn 34. Inside the housing 32 the ducts are isolated from each other. The fluid duct 11 communicates with the fluid filter chamber 3, and the air duct 13 communicates with the air filter chamber 7. The fluid filter chamber 3 is further connected with a duct 15 which extends through a tube 38 which, in extension of the piercing thorn 34, is connected with the housing 32 and protrudes to the opposite side of the housing 32. Two wing-shaped portions 40, 42 laterally engage with the tube 38, said wing-shaped portions 40, 42 being configured as quadrantal sectors and extending between the tube 38 and the housing 32. The two wing-shaped portions 40, 42 together form a semicircle located in a plane extending at right angles to the plane of the plate-shaped housing 32. On both sides of the wing-shaped portions 40, 42 concentric ribs 44 are provided which facilitate the gripping by hand. Thus the wing-shaped portions 40, 42 form a gripping part, and the plate-shaped housing 32 forms a manually actuated impact surface when the piercing thorn 34 is inserted into a stopper, such as the cap 24 of the multidose vial 10.

In the wing-shaped portion 40 a vent hole 46 communicating with the air filter chamber 7 is provided. In the air flow path the air filter membrane 9 contained in the air filter chamber 7 is arranged between the air duct 13 and the vent hole 46. It is envisaged that a withdrawal spike for use in the present invention could omit the fluid filter membrane 9, since this could conceivably inhibit flow of component out of the vial.

At the end of the tube 38 a connecting piece 17 having an inner cone 19 and externally threaded ribs 21 of a Luer-Lock connector is arranged. Said connecting piece 17 is annularly surrounded, at a lateral distance, by a protective jacket 48. Said protective jacket 48 comprises a bottom portion 49 sealingly adjoining the base part of the connecting piece 17. The protective jacket 48 protrudes beyond the outer end of the connecting piece 17. At the edge of the pot-shaped protective jacket 48 a hinged cover 50 is fastened by a living hinge 51. Said cover 50 is further connected via a toggle joint arm 52 with the protective jacket 48. Said toggle joint arm 52 effects a snapping behaviour of the cover 50 which assumes either an open position (FIGS. 9 & 10) or a closed position (FIGS. 2, 5, 7 and 8, in particular). On the inside of the cover 50 a projecting edge 53 is arranged which, in the closed position of the cover 50, fittingly engages with the protective jacket 48. Further, a cylindrical closing part 54 is provided on the inside of the cover 50, said closing part 54 entering the inner cone of the connecting piece 17 in the closed position.

Inside the connecting piece a valve 71 is arranged. Said valve 71 comprises a valve disk 73 and a valve opener 75. The edge of said valve disk 73 of elastomeric material is clamped between the edge of the tube 38 and an edge of the connecting piece 17 and is gripped over by a sleeve 23 of the connecting piece 17. The valve disk 73 comprises a slot or opening structure. It is of the self-closing type, i.e. without exertion of external pressure it assumes the closed position.

The valve opener 75 is a tubular part containing a longitudinal duct 77 having an end pushing against the central portion of the valve disk 73. On the circumferential area of the valve opener 75, projections (not shown) protruding to the outside are arranged which are distributed over the circumference. The upper ends of said projections push against an annular shoulder 25 inside the connecting piece 17. Above the annular shoulder the inner cone 19 is located.

Below the valve disk 73 a cavity 79, which is enlarged relative to the duct 15 through the tube 38, is provided and the valve disk can move into said cavity 79 when it is deformed by the valve opener 75.

During use of the withdrawal spike 30 a male Luer cone is placed upon the connecting piece 17, or the cone 302 of a syringe 300 is inserted into the inner cone 19. During this process the penetrating part pushes against the front face of the valve opener 75 whereby the latter is displaced inside the connecting piece 17 thus pressing the valve disk 73 open. The valve 71 is thus forced to remain in the open position as long as the external part protrudes into the connecting piece 17. Thereafter the spring action of the valve disk 73 causes valve opener 75 to return into its initial position, and the valve 71 closes again.

Any fluid residues in the connecting piece 17 or in the valve 71 are prevented from flowing out by closing the cover 50.

A drawback of inserting such a withdrawal spike 30 into a multidose vial 10 is that the spike 30 is not secured to the vial 10 other than by frictional forces between the thorn 34 and the cap 24. The spike 30 is therefore liable to be displaced from and within the vial 10. Possible displacements include: an axial displacement, wherein the thorn 34 is displaced axially relative to the cap 24; and/or an orientational displacement (or a wobble), wherein the longitudinal axis of the thorn 34 becomes non-parallel with a longitudinal axis of the vial 10. This has potentially serious consequences. In a worst case, the spike may be displaced to such an extent that the thorn 34 is completely dislodged from the puncture hole that it has created in the cap 24. The vial 10 would then have to be discarded without further use, i.e. wasting any remaining doses, because of the risk of lack of sterility due to the exposed puncture hole and/or to the need to insert another withdrawal spike 30.

Even if the thorn 34 were not completely dislodged, any displacement thereof from an ideal predetermined position within the vial 10 could have serious consequences. The ideal position of the thorn 34 with respect to the vial 10 locates the thorn tip 36 at a predetermined depth within the vial chamber 20. The predetermined depth is selected so that the thorn tip 36 is inserted beyond the cap 24 so that the two ducts in the conical area of the tip 36 are not blocked at all by the cap 24, which could hinder withdrawal of the vial contents.

Another consideration is to minimise wastage of the vial contents. Typically, the vial contents are withdrawn by inverting the assembled vial 10 and spike 30 so that gravity urges the contents towards the vial cap 24, whence the contents can be withdrawn via the thorn 34, specifically via the fluid duct thereof and its opening in the thorn tip 36. With the assembly inverted, any contents lying between the cap 24 and the fluid duct opening in the thorn tip 36 are inaccessible and hence cannot be withdrawn. Accordingly, if the thorn tip 36 were to be inserted beyond the depth necessary for its ducts to be clear of the cap 24, then the volume of inaccessible contents would increase.

Yet another consideration is to ensure central penetration of the cap 24 by the piercing tip 36 of the thorn 34. If the penetration were to be significantly off-centre, there is a risk that the duct openings in the tip 36 could become at least partially blocked by the interior wall of the vial neck portion 16.

It is therefore desirable to ensure that the spike 34 is inserted to the correct predetermined depth within the vial 10, and at the right location and orientation. This might be accomplished by skilful manipulation by a user. For example, a skilled practitioner might be able to insert the spike 34 to the correct depth and at the right location and orientation. However, this approach is liable to human error and a consistent insertion could not be ensured.

It is also desirable to secure the spike 30 to the vial 10 to eliminate the displacement issues noted above. Again, this might be accomplished by a skilled practitioner who might be able to hold the spike 30 to the vial 10 to prevent their relative displacement. However, this approach is again liable to human error and further might require the use of both hands and/or awkward manipulation. A more user-friendly, less fatiguing approach is therefore desirable.

An ancillary problem associated with known withdrawal spikes 30 such as that described above relates to the valve 71 within. It is possible for fluid residues to become trapped in the valve, where bacteria could collect and hence pose a contamination risk to subsequent fluid withdrawals through the spike 30. In particular, fluid residues may be trapped in difficult to access areas within the valve, particularly in the area above the valve disk 73, such as in the recess between the inner cone 19 and the top of the valve opener 75.

Swabbable valves, which present a flush upper surface when in a sealed, closed position for easy swabbing by, e.g. disinfectant, are known. One known manufacturer of such valves is Halkey-Roberts, and examples are disclosed in U.S. Pat. No. 6,036,171 and WO2005/115504.

It is therefore envisaged that the valve arrangement described above might be replaced by a swabbable valve. In particular, a swabbable valve could be housed within the connecting piece 17 so as to present an upper surface that, when in the closed position, is flush with the upper surface of the connecting piece 17. With such an arrangement, the recess between the inner cone 19 and the top of the valve opener 75 would be removed. Indeed, it is envisaged that withdrawal spikes could, in general and independently of any association with an adapter, be provided with swabbable valves to benefit from the advantages associated therewith of eliminating areas within which bacteria can collect.

The Adapter of 'Multidose Vial Adapter'

The adapter of the Multidose Vial Adapter of WO 2008/117178 is illustrated in FIGS. 3A and 3B. The adapter 60 is similar in construction to the integral adapter of the present invention and comprises a hollow cylindrical body 62 defined by an outer wall 63 having a first end 64 and a second end 66 and a longitudinal axis. A skirt 68 projects from the first end 64 of the body 62. The skirt 68 includes a substantially cylindrical body 70 having the same longitudinal axis but a greater diameter than the body 62. A tapered shoulder portion 72 connects the skirt body 70 to the adapter body 62. A circular flange 74 extends outwardly from the second end 66 of the outer wall 63. The flange 74 extends in a plane that is perpendicular to the longitudinal axis of the body 62. At the periphery of the flange 74, there is disposed a diametrically opposed pair of upstanding rim portions 76.

A first retaining member is provided at the first end of the adapter body 62 for securely retaining a multidose vial 10. The multidose vial 10 may be of the known type above with reference to FIGS. 1 and 4. The first retaining member comprises a diametrically opposed pair of inwardly extending first projections 78, each disposed at a free end 80 of an associated resiliently deflectable tab 82. Each tab 82 is defined by a pair of parallel, axial slots 84 in the outer wall 63, the slots 84 extending at least partially from the first end 64 towards the second end 66 of the outer wall, and a perpendicular slot 85 interconnecting the slots 84 at the first end 64. At the fixed end of each tab 82, a dimple 86 is formed in the outer wall 63 to provide a portion of reduced thickness for a purpose to be described below. Each first projection 78 includes a flat portion 88 extending in a plane perpendicular to the longitudinal axis of the adapter body 62 and an oblique camming surface 90 that together define a wedge shaped profile, being thinner at the first end 64 of the adapter body 62 than towards the second end 66 thereof.

A second retaining member is provided at the second end 66 of the adapter body 62 for securely retaining a withdrawal spike 30. The withdrawal spike 30 may be of the known type discussed in the opening portion of the specification with reference to FIG. 2. The second retaining member is described in more detail on page 11 of WO2008/117178.

The adapter 60 further includes a diametrically opposed pair of gripping surfaces 104. Each gripping surface is disposed on an outer surface of a boss 106 projecting from the outer wall 63. The gripping surfaces are arranged in line with the second projections 92, i.e. at 90° and 270° about the adapter circumference respectively. The gripping surfaces are ergonomically contoured to be gripped between a user's finger and thumb.

The adapter 60 comprises a unitary piece. That is to say, the body 62, skirt 68 and flange 74, and all components thereof are integrally formed. The adapter may suitably be formed by moulding. The adapter may be moulded from a thermoplastic material.

Assembly of "Multidose Vial Adapter"

The outer wall 63 of the adapter 60 has an interior surface that is sized and shaped to receive the cap 24 of the multidose vial 10, i.e. the interior surface has a diameter that substantially matches the outer diameter of the cap skirt 28. The close fit of the cap 24 within the adapter body 62 ensures that the adapter 60 is centrally and firmly secured to the multidose vial 10 with minimal axial misalignment of the adapter 60 and vial 10.

The first retaining member engages the cap 24. In particular, the flat portions 88 of the first projections 78 engage the underside of the cap skirt 28. The interengagement prevents the vial 10 from being displaced axially out of the adapter 60. Preferably, the interengagement is irreversible such that once the adapter 60 has been retained on the vial cap 24 it is locked in place. This locking will not only prevent accidental relative displacement of the vial 10 and the adapter 60, but will also prevent deliberate attempts to remove the adapter 60 from the vial 10.

The adapter skirt body 70 and shoulder portion 72 together define an interior surface that is sized and shaped to receive an upper portion of the multidose vial 10 including at least part of the vial body portion 14 and the vial shoulder portion 18. In particular, the adapter skirt interior surface has a profile that substantially matches that of the relevant portion of the outer surface of the outer wall 63. The close fit of the upper portion of the vial 10 within the adapter skirt 68 further ensures that the adapter 60 is centrally and firmly secured to the vial 10 with minimal axial misalignment of the adapter 60 and vial 10. In addition, excessive axial displacement of the vial 10 into the adapter body 62 is prevented by the interengagement of the respective adapter skirt and vial shoulder portions 72, 18.

The flange 74 and rim portions 76 are sized and shaped to receive the plate-shaped housing 32 of the withdrawal spike 30, i.e. the inner diameter of the rim portions 76 substantially matches the outer diameter of the spike housing 32, as described in more detail on page 12 of WO2008/117178.

By virtue of the central, axially aligned connection of the adapter 60 to the vial 10, and by virtue of the central, axially aligned connection of the withdrawal spike 30 to the adapter 60, the spike thorn 34, is centrally and axially aligned with the vial 10.

The adapter 60 thus serves as an intermediary member to couple the withdrawal spike 30 with the multidose vial 10. The adapter locates the withdrawal spike 30 in a predetermined position with respect to the multidose vial 10 when the withdrawal spike 30 is coupled to the multidose vial 10 by the adapter 60. The predetermined position corresponds to the spike thorn 34 being in axial alignment with the longitudinal axis of the multidose vial 10 and at a depth just sufficient to ensure that the duct openings of the thorn tip 36 are not blocked by the plug 26 of the cap 24 and yet not so deep as to include a significant volume between the underside of the plug 26 and the fluid duct opening in the thorn tip 36.

Method of Assembling of "Multidose Vial Adapter"

The multidose vial 10 and the withdrawal spike 30 are coupled via the adapter 60 in the following manner.

First, the withdrawal spike 30 is fitted to the adapter 60 in the manner described on page 13 of WO2008/117178.

Second, the adapter 60 is fitted to the vial 10. This second stage is typically carried out at the point of use (i.e. by the person administering the vial contents). In particular, the flip-off disc of the cap 24 has to be removed from the vial 10 before the vial 10 is inserted into the adapter skirt 68 by relative axial motion between the adapter 60 and the vial 10. In this regard, the flared shape of the skirt 68 assists in the insertion. On further relative axial motion, the upper surface of the cap 24 enters the first end 64 of the adapter body 62 and is brought into contact with the first projections 78. By virtue of the oblique angle of the camming surfaces 90, urging the vial 10 axially relative to the adapter 60 urges the first projections 78 to be deflected radially outwardly via resilient deflection of the free ends 80 of the tabs 82 from which the first projections 78 extend. The dimples 86 aid the deflection of the tabs 82. The radial deflection continues until the first projections 78 are sufficiently deflected to allow the passage of the cap 24, i.e. until the deflected first projections 78 define an inner diameter that is equal to the outer diameter of the cap 24, notably the outer diameter of the cap skirt 28. The cap 24 is then passed through the first projections 78 until the underside of the cap skirt 28 has passed beyond the first projections 78. At that point, the tabs 82 are urged to return from their deflected positions by virtue of their resilience, whereupon the flat portions 88 underlie the underside of the cap skirt 28 to retain the cap 24 within the adapter body 62 as discussed above.

Hence, typically, the withdrawal spike 30 is first connected to the adapter 60 and then the vial 10 is connected to the assembled withdrawal spike 30 and adapter 60. It will be appreciated, however, that the fitting order may be reversed, such that the adapter 60 is first connected to the vial 10 and then the spike 30 is connected to the assembled vial 10 and adapter 60. During fitting the withdrawal spike 30 to the assembled vial 10 and adapter 60 in this alternative, the piercing tip 36 of the thorn 34 is brought into contact with the upper surface of the cap 24 and subsequently penetrates and passes through the cap plug 26 until it reaches the above-mentioned predetermined position. The assembly process may either be manual or automated, or a combination of the two.

Method of Preparing Multiple Doses of a Component of "Multidose Vial Adapter"

The assembly can be used in the preparation of multiple doses of a component. A first dose is withdrawn from the multidose vial chamber 20 by inserting an injection device, such as a syringe, into the withdrawal spike 30 and drawing substantially a dose of, for example 0.5 ml volume, into the injection device via the spike 30 in a conventional manner. This might include inverting the assembly to ensure that the component is accessible by the fluid duct of the thorn tip 36. A second and subsequent doses are then withdrawn by inserting, in turn, subsequent injection devices into the spike 30 and correspondingly drawing substantially a dose into each subsequent injection device via the spike 30 in a conventional manner. The insertion and withdrawal steps are continued until the vial contents are depleted.

It should be noted that the correct depth of insertion of the spike thorn tip 36 that is assured by the spike and adapter assembly enables the maximum amount of contents to be removed from the multidose vial 10 to the extent that it may be possible to withdraw an additional dose over the nominal specified number of doses for the multidose vial 10, by virtue of the overfill allowance mentioned above. Thus, the invention has the potential to reduce wastage and hence to provide a more efficient administration of vial contents.

General

The term "comprising" encompasses "including" as well as "consisting" e.g. a composition "comprising" X may consist exclusively of X or may include something additional e.g. X+Y.

The word "substantially" does not exclude "completely" e.g. a composition which is "substantially free" from Y may be completely free from Y. Where necessary, the word "substantially" may be omitted from the definition of the invention.

The term "about" in relation to a numerical value x means, for example, x±10%.

BRIEF DESCRIPTION OF DRAWINGS

The invention is described, purely by way of example, by reference to the attached Figures, in which.

MODES FOR CARRYING OUT THE INVENTION

Integral Adapter

Figure 7:
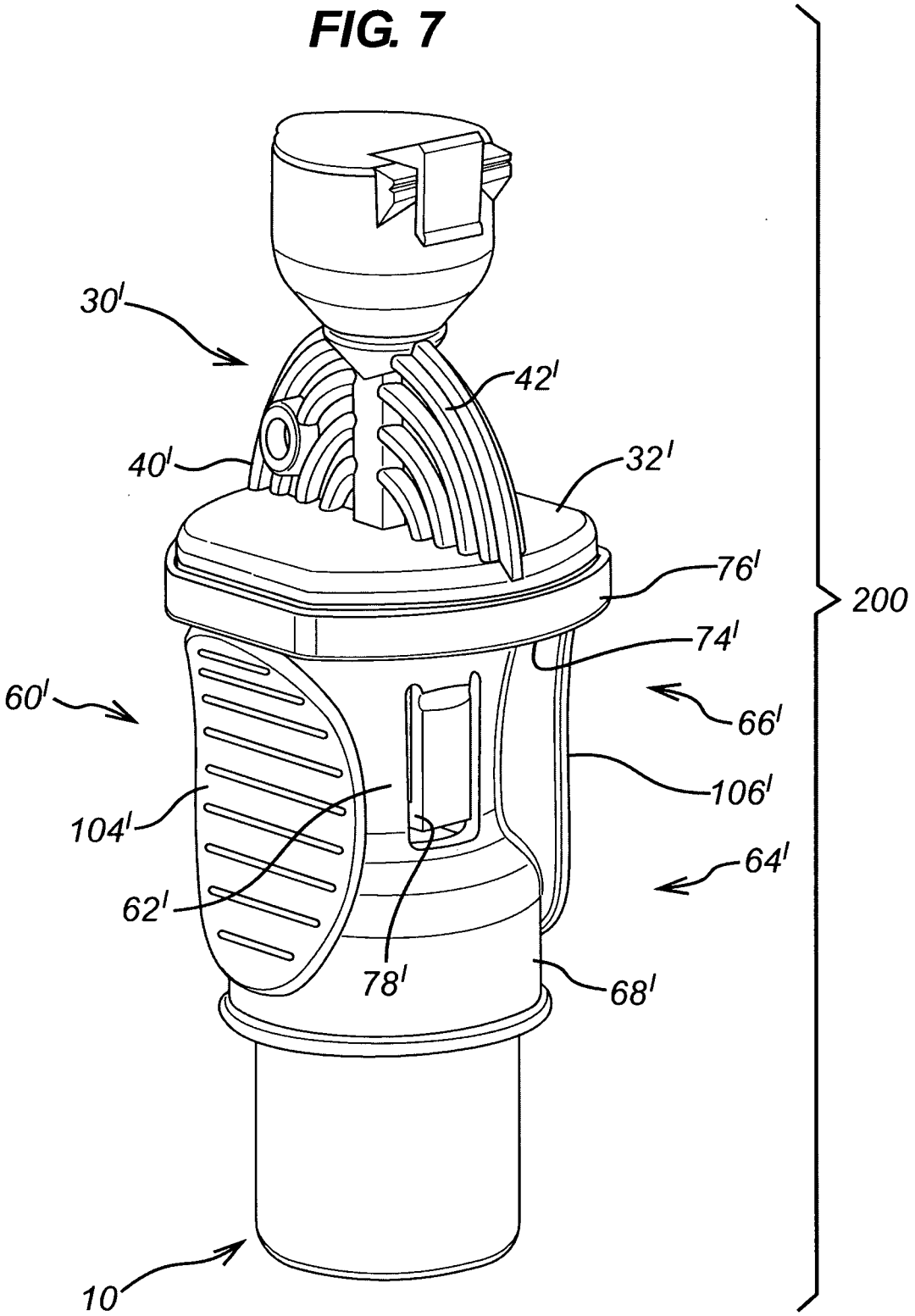
FIG. 7 corresponds to FIG. 5, but illustrates a unitary withdrawal spike with integral adapter of the invention.
Figure 9:
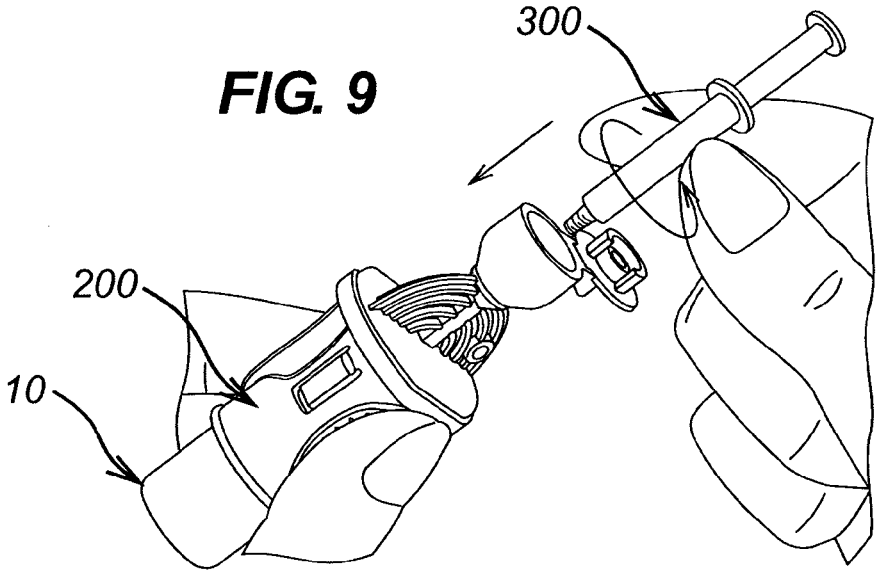
FIG. 9 illustrates a schematic step of connecting a syringe to an assembly of the invention.

With reference, in particular, to FIG. 7, the withdrawal spike unit 200 of the invention essentially corresponds to the withdrawal spike 30 and adapter 60 described above, but integrally formed with one another instead of being assembled together. By virtue of the large number of corresponding features, like features of the invention are given the same references as those described above in respect of the separate withdrawal spike 30 and adapter 60, but with the addition of a prime (') to differentiate. Since most features are identical, the following description will focus on the differences over the separate withdrawal spike 30 and adapter 60 described above.

The adapter component 60' of the withdrawal spike unit 200 corresponds to the adapter 60, except in that it does not include a second retaining member at the second end 66' of the adapter body 62'. Instead, the second end 66' of the adapter body 62' is formed integrally with the housing 32' of the withdrawal spike component 30'. This integral formation means that the withdrawal spike component 30' and the adapter component 60' are rigidly interconnected and hence there is no play that might have existed between an assembled withdrawal spike 30 and adapter 60. Since the adapter component 60' and the withdrawal spike component 30' are formed integrally, it is not necessary for the adapter component 60' to include a flange 74' nor a corresponding rim 76' for receiving the withdrawal spike housing 32'. Nevertheless, these may be provided in order to assist in the integration, during manufacture, of the adapter component 60' and the withdrawal spike component 30'.

Method of Assembling

The steps necessary to assemble the withdrawal spike unit 200 to a vial 10 correspond to those to assemble the adapter 60 to a vial 10. However, because the adapter component 60' and the withdrawal spike component 30' are formed integrally into the unit 200 at manufacture, the separate step of fitting the withdrawal spike 30 to the adapter 60 is omitted. The elimination of that step facilitates full automation of the process of fitting the unit 200 to a vial 10. Accordingly, full, automated manufacture and assembly, at a single site, of an assembly comprising a vial 10 and a withdrawal spike unit 200 is possible. Hence, the withdrawal spike unit 200 and vial 10 can be supplied pre-assembled. A final step of the automated manufacturing process can be the encapsulation of the assembled vial 10 and withdrawal spike unit 200 in packaging. The automated assembly leads to a faster, more efficient, more consistent process. Additional benefits possible from the pre-assembly include reduced shipping costs, and reduced possibility of component parts becoming separated prior to use.

Also, because in this method the withdrawal spike unit 200 is fitted to the vial 10 at source, it is not necessary to provide the vial with a flip-off disk. The fitted withdrawal spike unit 200 will perform the same function as the flip-off disk, i.e. protecting the upper surface of the vial stopper 26 from contamination between manufacture and use. Thus, the step of removing the flip-off disk can be eliminated.

Where the pre-assembled assembly is encapsulated in packaging, that packaging may be removed prior to use. Alternatively, the packaging may be such as to allow an injection device to be inserted into the withdrawal spike unit 200 through the packaging.

Alternatively, the withdrawal spike unit 200 and the vial 10 can be encapsulated in packaging without having first been assembled together. The withdrawal spike unit 200 and the vial 10 would in this case be assembled subsequently, such as at the point of use (e.g. by a clinician just prior to administration of a dose of the component). This alternative method retains the advantages of reduced shipping costs and reduced possibility of component parts becoming separated prior to use. Moreover, the packaging may keep the withdrawal spike unit 200 and the vial 10 sterile, eliminating the need for the flip-off disk on the vial.

In accordance with this alternative, the packaging is removed before the step of fitting the withdrawal spike unit 200 to the vial 10. The fitting step may be as described above.

Optionally, in accordance with this alternative, non pre-assembled embodiment, the withdrawal spike unit 200 may be partially fitted to the vial 10 prior to encapsulation. In particular, in this alternative the vial 10 is inserted into the adapter skirt 68' far enough to be at least loosely retained by frictional engagement between the vial body portion 14 and the skirt body 70, but not so far as for the vial cap 24 to be brought into contact with the piercing tip 36' of the withdrawal spike thorn 34'.

In this manner, the partially assembled components are in place for quick and easy completion of the fitting step by the end user; all that is required after removal of the packaging is to push the vial 10 and the withdrawal spike unit 200 further together to complete the assembly, whereby the piercing tip 36' is brought into contact with the upper surface of the cap 24 and subsequently penetrates and passes through the cap plug 26 until it reaches the above-mentioned predetermined position.

A further advantage of this alternative embodiment is that it allows inspection of a label attached to the vial shell 12 before the full insertion of the vial 10 into the skirt portion 68'. For example, a label may be provided to include identifying information and data, such as a lot number and/or expiration date for the contents. If the vial 10 were packaged ready-assembled with the withdrawal spike unit 200, it might not be possible to read such a label since it could be obscured by the adapter skirt 68'.

The packaging may consist of a base and a cover, the base and cover together defining a compartment within which are housed the withdrawal spike unit and the vial. The base may comprise a board, such as a rectangular board of laminated construction. The cover may be a moulded plastics component. The cover is preferably at least partially transparent, to allow inspection of the contents (the withdrawal spike unit 200 and the vial 10) prior to removal of the packaging.

Figure 11:
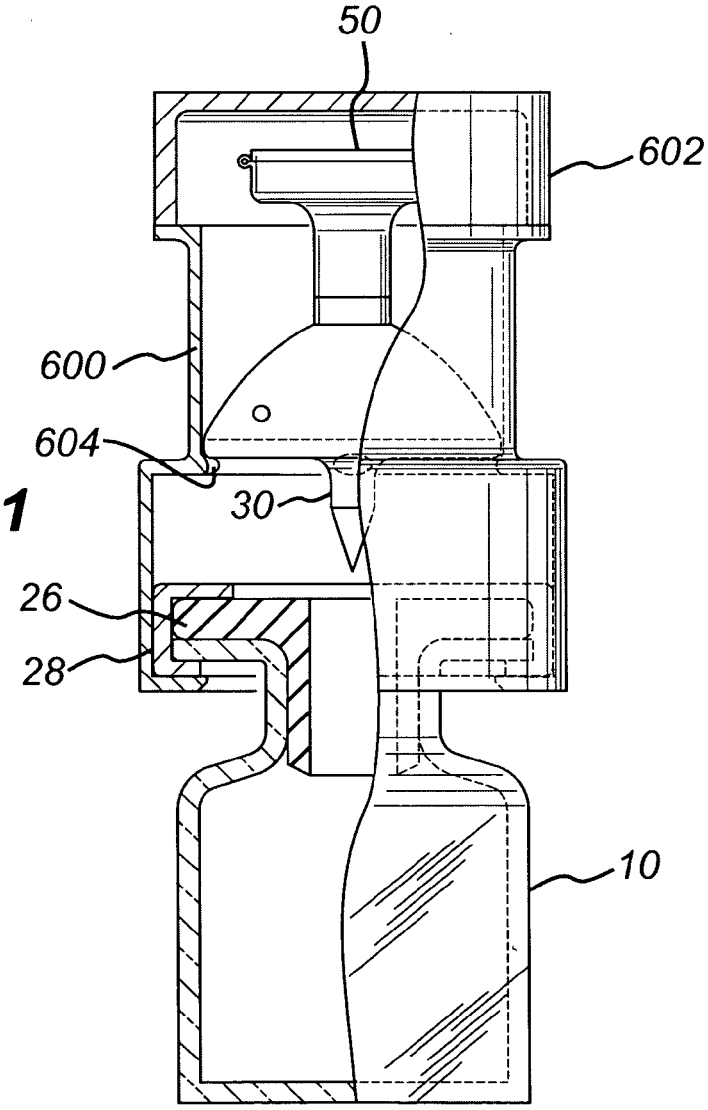
FIG. 11 illustrates an assembly with its cover closed.
Figure 10:
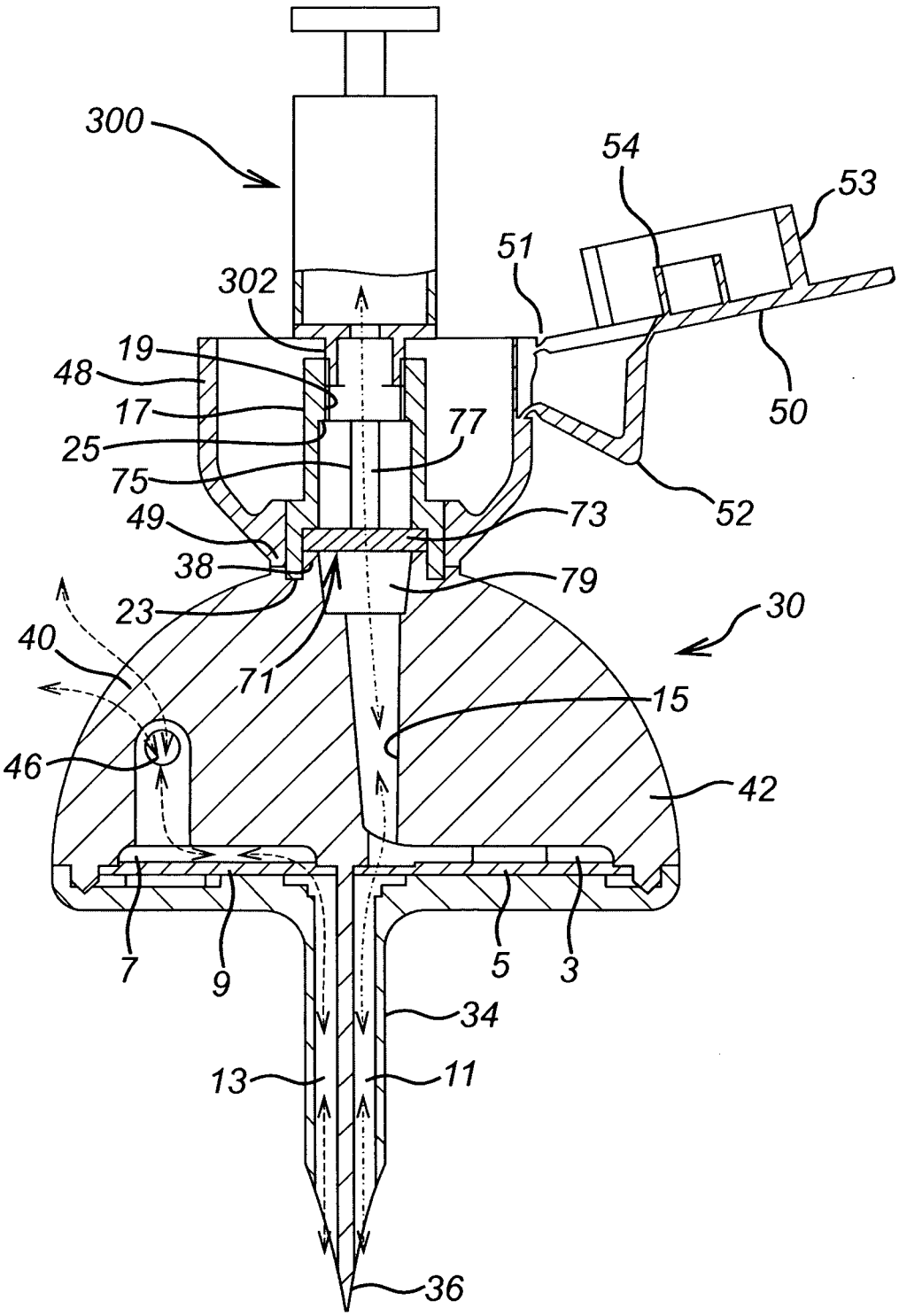
FIG. 10 illustrates, schematically and in cross-section, a syringe connected to the withdrawal spike component of the assembly of the invention, the adapter and vial components being omitted for clarity.

FIG. 11 shows a unitary device assembled in a factory ready for use by a medical practitioner. A preservative-free vaccine is introduced into vial 10, and the vial is sealed by rubber plug 26. Aluminium crimp cap 28 is then applied, but leaving open the central top portion of plug 26. The adapter 600 and spike 30 are mounted on the vial 10. The external face of the spike is protected by cover 50. Cover 50 is covered by upper cap 602. Adapter 600 includes four deformable protrusions 604, spaced at right-angles, which support spike 30 above plug 26. To use the assembly, cap 602 is opened and the spike is pushed past the protrusions 604 and into the vial 10 via plug 26. Cover 50 can be opened, allowing a syringe to be attached to spike 30 via a swabbable valve, thereby accessing the liquid contents of vial 10. After a dose has been withdrawn, the syringe is detached and lid 50 is closed.

It will be appreciated that alternative devices and methods can be envisaged by combining features as appropriate from each of the foregoing examples.

The foregoing description of the invention has been provided by way of example. It will be appreciated that numerous variations in detail can be made without departing from the spirit and scope of the invention.

Figure 1:
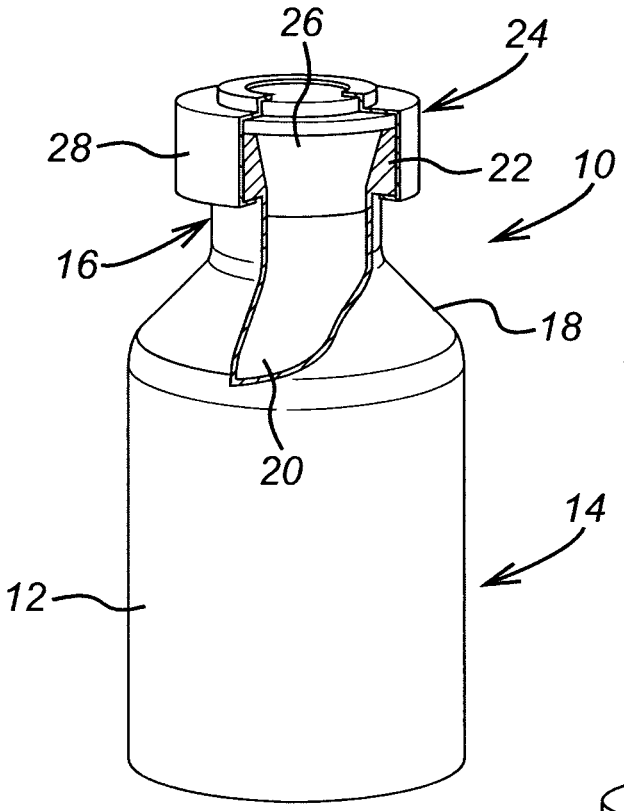
FIG. 1 illustrates, in a cut-away perspective view, a known vial.

For example, the withdrawal spike unit 200 has been described to be fitted to the known type of multidose vial 10 illustrated in FIG. 1, and hence has a shape and configuration appropriate to such a vial. However, it has been made clear that the invention is not limited in application to such vials 10 and accordingly the shape and configuration of the withdrawal spike unit 200 may be adapted mutatis mutandis to suit other sized and shaped multidose vials. Typically, the adapter component 60' has a shape and configuration appropriate to ensure the closest possible fit to an ISO standard vial 10.

Figure 2:
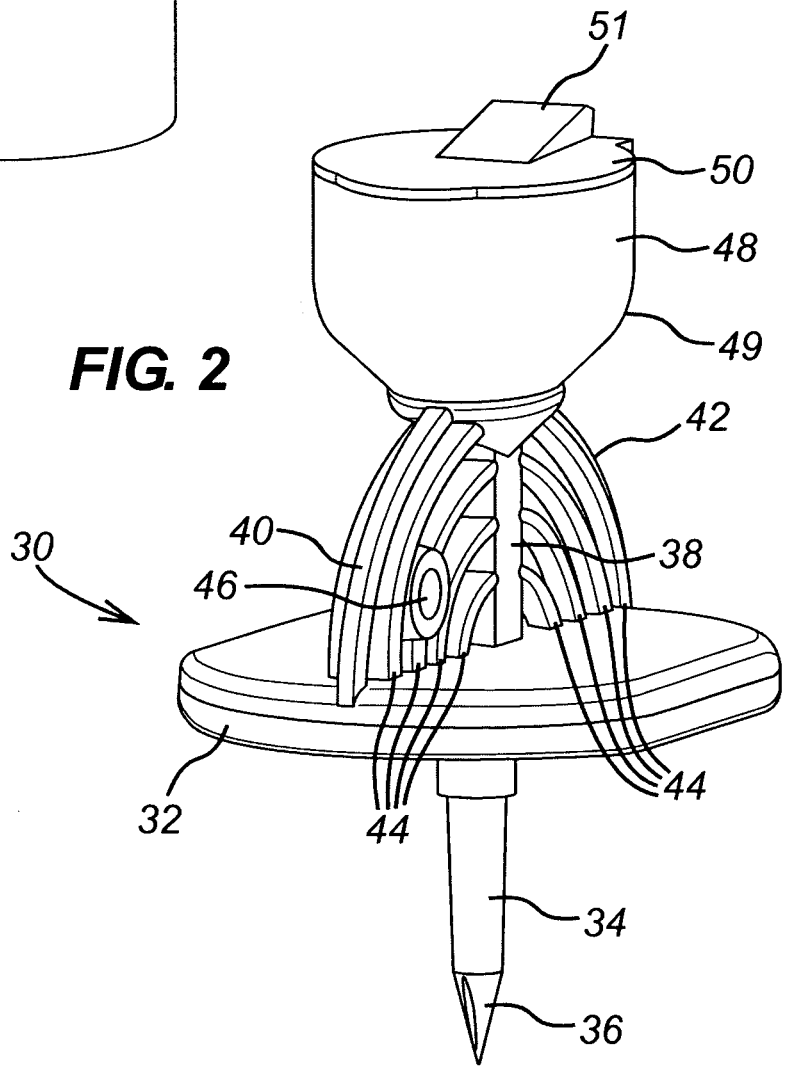
FIG. 2 illustrates, in a perspective view, a known sterile withdrawal spike.
Figure 3A:
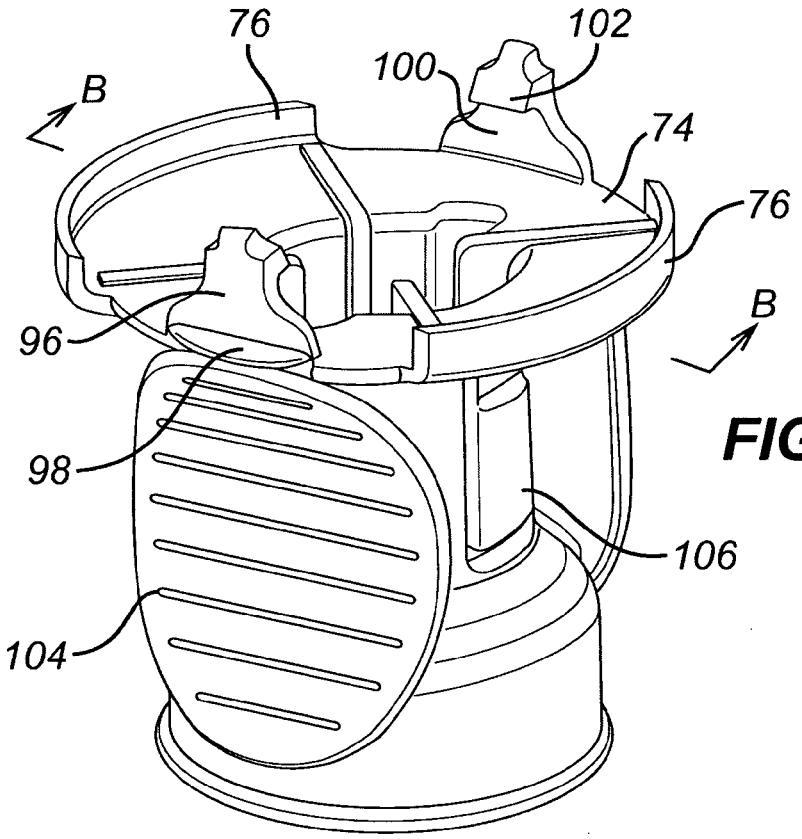
FIG. 3A illustrates, in a perspective view, an adapter.
Figure 3B:
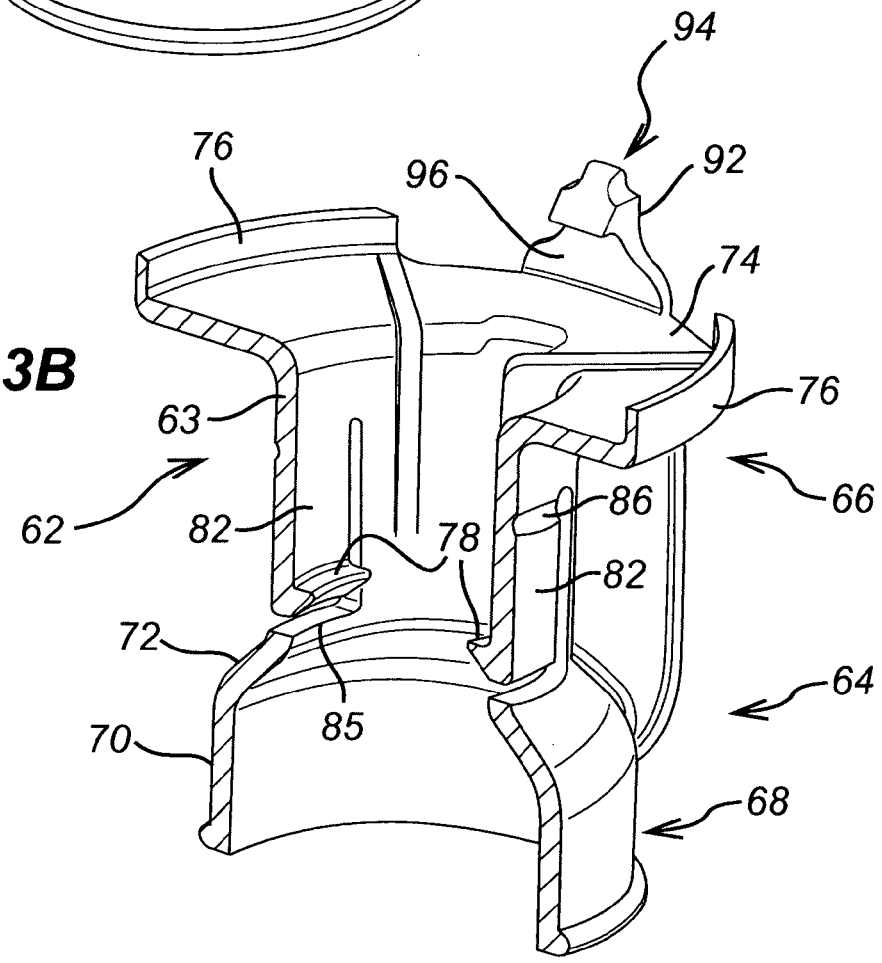
FIG. 3B illustrates, a cut-away view along line B-B of FIG. 3A.
Figure 4:
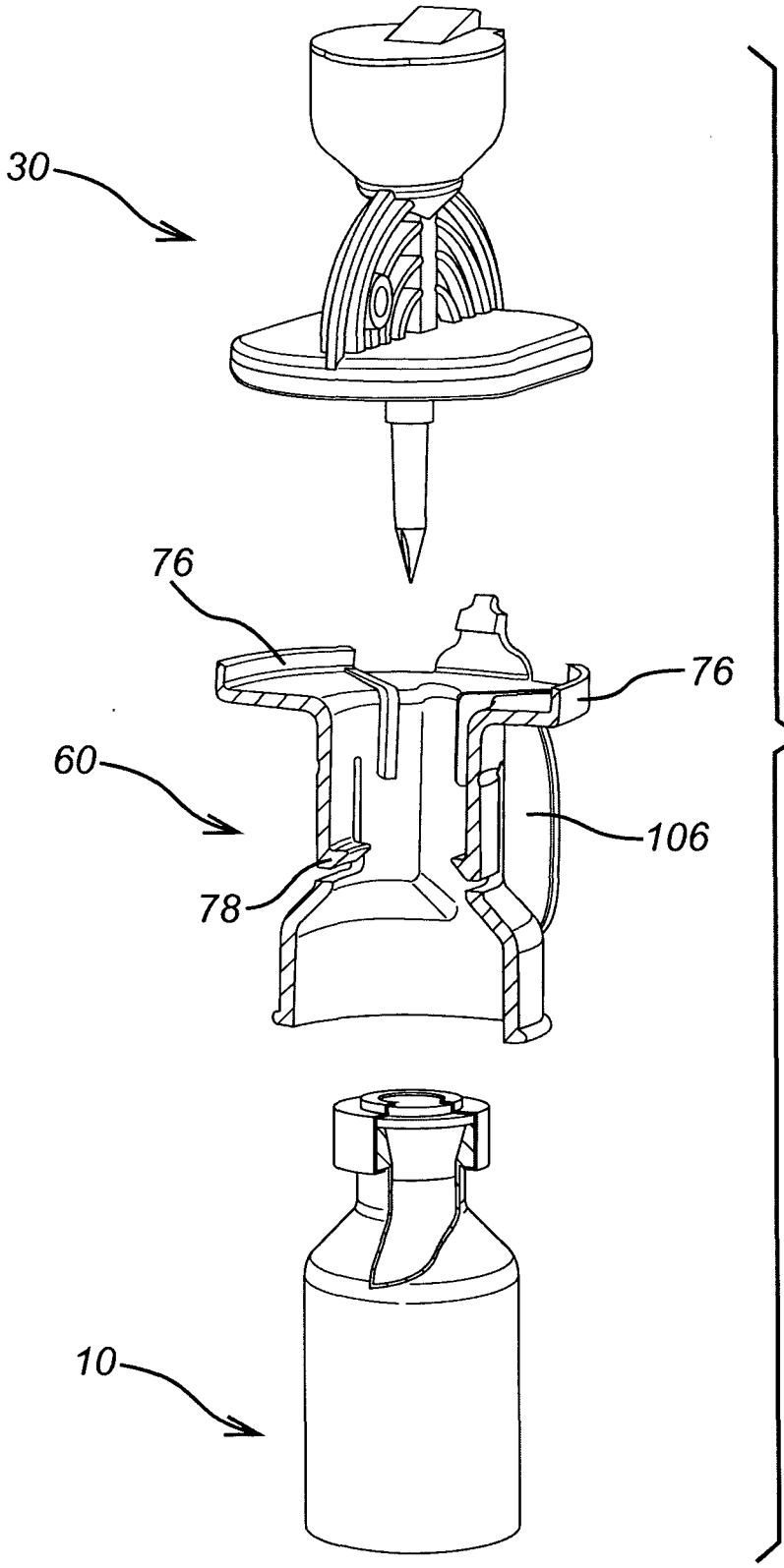
FIG. 4 illustrates an exploded view of the three components of an assembly axially aligned prior to assembly.
Figure 5:
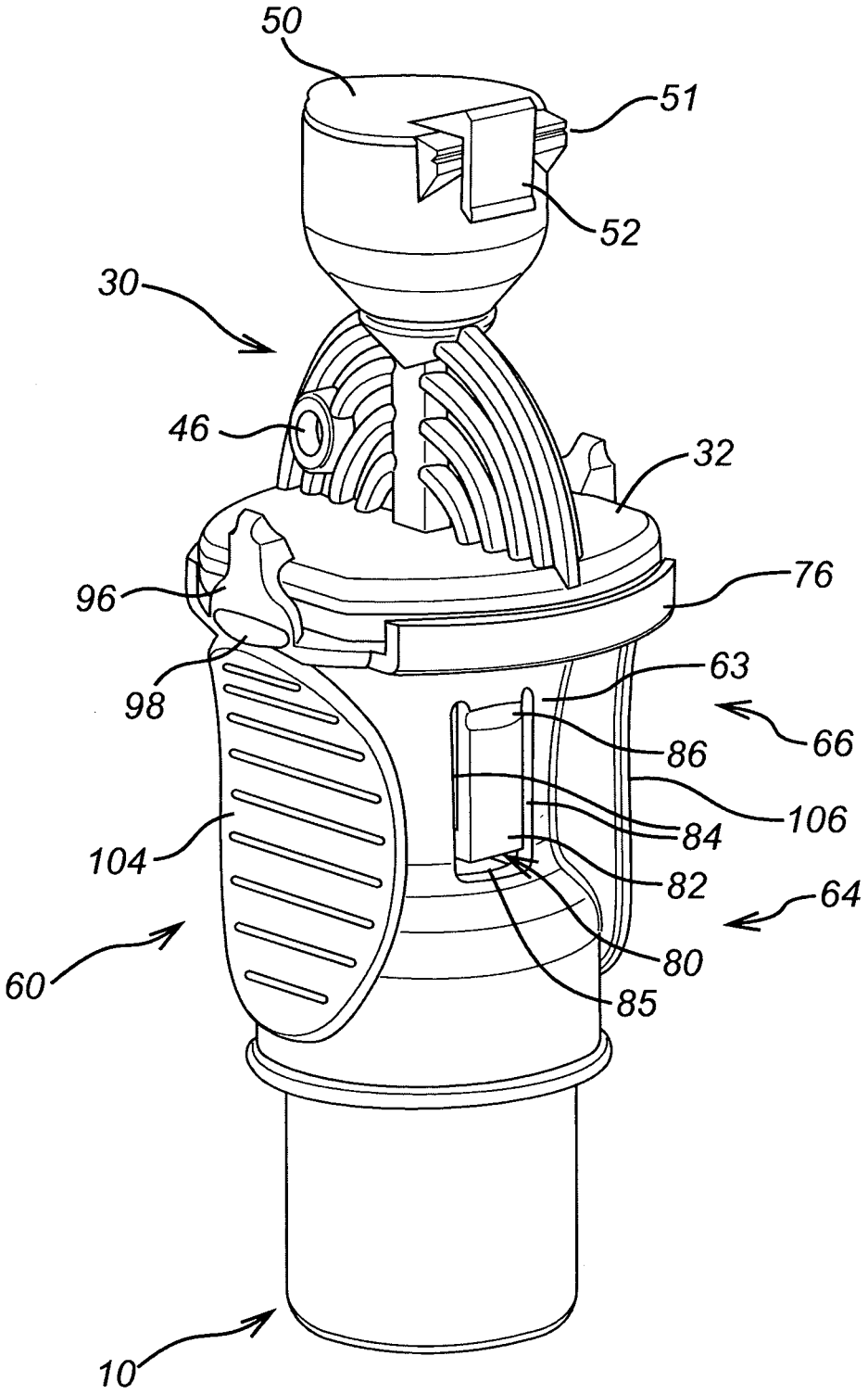
FIG. 5 illustrates the assembly of FIG. 4 in assembled form.
Figure 6:
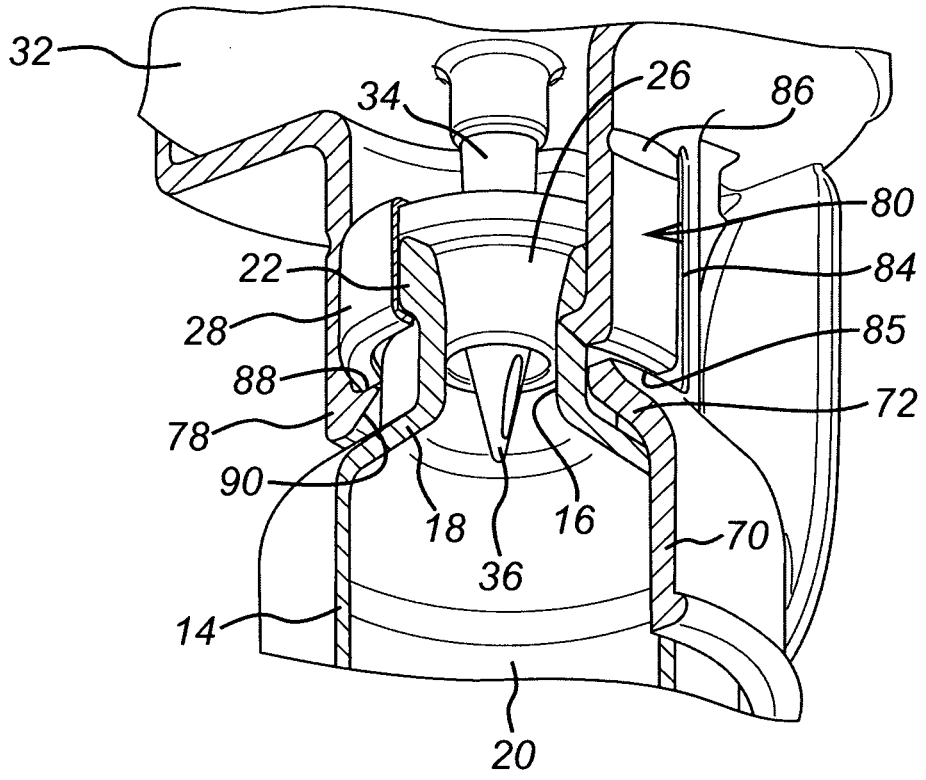
FIG. 6 shows a section of an adapter of the invention mounted on a vial.
Figure 8:
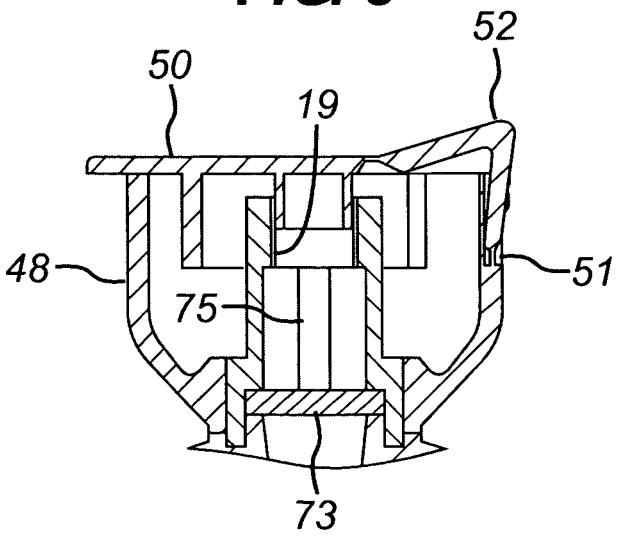
FIG. 8 illustrates a detail, partial cut-away perspective view of the assembly of FIG. 7.

Similarly, the description of the withdrawal spike component 30' is made purely by way of example by reference to a known withdrawal spike 30 illustrated in FIG. 2. However, it will be appreciated that the invention is not limited in application to the withdrawal spike unit 200 comprising such a spike component 30' and accordingly the shape and configuration of the adapter component 60' may be adapted mutatis mutandis to suit other sized and shaped withdrawal spike component 30'.

Moreover, it has been found that the liquid filter of standard withdrawal spikes 30, which is typically included to block bacteria from entering a vial to which the spike is attached, could interfere with the smooth withdrawal of vial contents from the vial 10. Accordingly, the liquid filter may be omitted from a withdrawal spike component 30' of the withdrawal spike unit 200.

Although a desirable feature, the adapter skirt 68' is not necessary. If no skirt 68' were provided, excessive axial displacement of the vial 10 into the adapter component 60' could be prevented by interengagement of the first end 64' of the adapter body 62' and the shoulder portion 18 of the vial.

The retaining member need not comprise a pair of projections 78'. Instead, it might comprise a greater number of projections 78'. Alternatively, the retaining member could comprise a single projection, i.e. an annular projection. In this case, the single projection would not be disposed on a resiliently deflectable tab. Instead, the whole projection would have to be resiliently expandable.

The grip surfaces 104' need not be diametrically disposed. Indeed, since the withdrawal spike component 30' includes gripping portions 40', 42', the adapter component 60' need not have any grip surfaces. Similarly, if the adapter component does include sufficient grip surfaces 104', the gripping portions 40', 42' of the withdrawal spike component 30' may be omitted.

The invention claimed is:

1. A withdrawal spike unit including a withdrawal spike and an integral adapter configured to couple with a multidose vial, wherein the configuration of the withdrawal spike and the integral adaptor irreversibly engaged with the multidose vial will maintain sterility therein during and after withdrawal of a first sterile dose therefrom into a first device and will maintain sterility of a second dose withdrawn therefrom into a second device, the adapter comprising:

a hollow body defined by an outer wall having a first end and a second end formed integrally with the withdrawal spike; and a retaining member at the first end adapted to irreversibly engage at least a portion of the multidose vial such that the withdrawal spike is locatable in a predetermined position with respect to the multidose vial.

2. The withdrawal spike unit of claim 1, wherein the retaining member comprises at least one inwardly extending projection.

3. The withdrawal spike unit of claim 2, wherein the or each projection is disposed at a free end of an associated resiliently deflectable tab that is defined by a pair of slots in the outer wall of the adapter body, the slots extending at least partially from the first end towards the second end of the outer wall.

4. The withdrawal spike unit of claim 3, wherein the or each projection includes a camming surface for engagement by at least a portion of the multidose vial.

5. The withdrawal spike unit of claim 3, wherein the outer wall includes a thinned portion between the ends of the pair of slots at the fixed end of the or each tab to aid tab deflection.

6. The withdrawal spike unit of claim 1, wherein the withdrawal spike comprises:

a housing; and a piercing thorn, the thorn protruding centrally and perpendicularly from the housing, wherein a fluid flowpath is defined through the housing and the thorn.

7. The withdrawal spike unit of claim 6, wherein the withdrawal spike includes a swabbable valve in the flowpath within the housing.

8. The withdrawal spike unit of claim 6, further comprising a flange extending from the second end of the adapter body, the flange being formed integrally with the housing of the withdrawal spike.

9. The withdrawal spike unit of claim 8, wherein the flange comprises an annular disc that includes a rim extending about at least a portion of the flange periphery, the flange and rim being contiguous with the housing of the withdrawal spike.

10. The withdrawal spike unit of claim 1, further comprising a skirt projecting from the first end of the adapter body.

11. The withdrawal spike unit of claim 10, wherein the skirt is configured to enshroud at least a portion of the multidose vial, with an inner surface of the skirt having a shape that is adapted to match the contours of the relevant portion of the multidose vial.

12. The withdrawal spike unit of claim 1, further comprising at least one gripping surface.

13. The withdrawal spike unit of claim 12, wherein there is a pair of opposed gripping surfaces, each disposed on an outer surface of a boss projecting outwardly from the outer wall of the adapter body.

14. The withdrawal spike unit of claim 1, wherein the withdrawal spike and integral adapter comprises a unitary thermoplastic moulding.

15. An assembly comprising:

a multidose vial; and the withdrawal spike unit of claim 1.

16. The assembly of claim 15, wherein the multidose vial comprises:

a shell defining an interior chamber having an opening; and a cap hermetically sealing the opening.

17. The assembly claim 16, wherein the cap comprises a plug portion.

18. The assembly of claim 16, wherein the chamber contains multiple doses of a component.

19. The assembly of claim 18, wherein the component is preservative free.

20. The assembly of claim 18, wherein the component comprises an influenza vaccine.

21. The assembly of claim 15, wherein the retaining member at the first end of the adapter body retains at least a portion of the multidose vial such that the withdrawal spike is located in a predetermined position with respect to the multidose vial.

22. The assembly of claim 21, wherein the multidose vial comprises:

a shell defining an interior chamber having an opening; and a cap hermetically sealing the opening and wherein the multidose vial cap is received in the hollow body of the adapter and is engaged by the retaining member.

23. The assembly of claim 21, wherein the withdrawal spike comprises:

a housing; and a piercing thorn, the thorn protruding centrally and perpendicularly from the housing, wherein a fluid flowpath is defined through the housing and the thorn, and wherein said predetermined position comprises the thorn of the withdrawal spike being inserted through the multidose vial cap by a predetermined distance.

24. The assembly of claim 15, further comprising packaging encapsulating the multidose vial and withdrawal spike unit.

25. The assembly of claim 24, wherein the packaging comprises:

a base; and a cover secured to the base, the base and cover together defining a compartment within which are housed the withdrawal spike unit and the multidose vial.

26. The assembly of claim 25, wherein the base comprises a board.

27. The assembly of claim 25, wherein the cover is a moulded plastics component.

28. A method of assembling an assembly for administering multiple doses of a component, comprising the steps of:

providing a multidose vial containing the component;

providing a withdrawal spike unit as defined in claim 1; and fitting the withdrawal spike unit onto the multidose vial.

29. The method of claim 28, wherein the step of providing the multidose vial comprises the sub-steps of:

providing a shell defining an interior chamber having an opening;

filling the chamber with contents; and hermetically sealing the opening with a cap.

30. The method of claim 29, wherein the sub-step of hermetically sealing the opening with a cap comprises:

pushing a plug portion into the opening; and adding a skirt enshrouding the plug portion and at least a portion of the multidose vial.

31. The method of claim 29, wherein the or each projection includes a camming surface for engagement by at least a portion of the multidose vial and the fitting step comprising:

engaging the camming surface of the or each projection with the multidose vial cap;

resiliently deflecting outwardly the associated deflectable tab to a deflected position via a relative axial force between the multidose vial and the adapter; and passing the cap beyond the or each projection, the or each projection hence returning from the deflected position to retain the cap within the hollow adapter body.

32. The method of claim 28, further including the step of removing a flip-off disk from the multidose vial prior to the fitting step.

33. The method of claim 28, further comprising a step of encapsulating the multidose vial and withdrawal spike unit in packaging.

34. The method of claim 33, wherein the encapsulating step takes place prior to the fitting step, the fitting step occurring after subsequent removal of the withdrawal spike unit and the multidose vial from the packaging.

35. The method of claim 34, wherein the steps of removing the packaging and fitting the withdrawal spike unit onto the multidose vial take place at the point of use.

36. The method of claim 28, wherein each step is carried out at the place of manufacture.

37. The method of claim 36, wherein the fitting step is carried out in an automated manner.

38. The method of claim 28, wherein the component comprises a vaccine.

39. The method of claim 38, wherein the component is preservative free.

40. The method of claim 38, wherein the component comprises an influenza vaccine.

41. A method of preparing multiple doses of a component comprising the steps of:

assembling the assembly in accordance with the method of claim 28;

inserting an injection device into the withdrawal spike unit;

withdrawing a sterile dose of component from the multidose vial into the injection device through the withdrawal spike unit; and repeating the inserting and withdrawal steps using further injection devices.

42. The withdrawal spike unit of claim 1, wherein the withdrawal spike further comprises a connecting piece adapted to independently engage said first and said second devices, wherein the connecting piece is in fluid connection with the multidose vial.

43. The withdrawal spike unit of claim 42, wherein the connecting piece is configured as a Luer-Lock connector.

* * * * *